US008383975B2

(12) United States Patent
Lin et al.

(10) Patent No.: US 8,383,975 B2
(45) Date of Patent: Feb. 26, 2013

(54) ENHANCED WITHSTAND VOLTAGE MICRO SWITCH

(75) Inventors: Ching-Hsin Lin, Taipei Hsien (TW); King-Long Lee, Taipei Hsien (TW)

(73) Assignee: Zippy Technology Corp., Hsin-Tien, Taipei Hsien (TW)

( * ) Notice: Subject to any disclaimer, the term of this patent is extended or adjusted under 35 U.S.C. 154(b) by 246 days.

(21) Appl. No.: 13/016,749

(22) Filed: Jan. 28, 2011

(65) Prior Publication Data

US 2012/0193197 A1 Aug. 2, 2012

(51) Int. Cl.
*H01H 5/30* (2006.01)

(52) U.S. Cl. ..... 200/409

(58) Field of Classification Search ..... 200/405, 200/407–409, 440, 442, 449, 450, 451, 453, 200/459–461, 520
See application file for complete search history.

(56) References Cited

U.S. PATENT DOCUMENTS

| | | | | |
|---|---|---|---|---|
| 4,254,313 | A * | 3/1981 | Baader | 200/452 |
| 5,111,010 | A * | 5/1992 | Kokubu et al. | 200/461 |
| 5,459,295 | A * | 10/1995 | Ohta et al. | 200/461 |
| 6,713,702 | B1 * | 3/2004 | Lee | 200/520 |
| 7,081,593 | B2 * | 7/2006 | Hopkins | 200/402 |
| 7,205,496 | B2 * | 4/2007 | Schober et al. | 200/329 |
| 7,232,971 | B2 * | 6/2007 | Chen | 200/460 |
| 7,371,983 | B1 * | 5/2008 | Lin et al. | 200/237 |

FOREIGN PATENT DOCUMENTS

| | | |
|---|---|---|
| TW | 289485 | 10/1996 |
| TW | 507921 | 10/2002 |
| TW | M350087 | 2/2009 |

* cited by examiner

*Primary Examiner* — Edwin A. Leon
(74) *Attorney, Agent, or Firm* — Muncy, Geissler, Olds & Lowe, PLLC

(57) ABSTRACT

An enhanced withstand voltage micro switch includes a base and a cap covering the base. The cap has a press element movable up and down. The base has a conductive member depressed by the press element and a connecting section extended upwards. The base also includes a first contact, and a second contact extended from the connecting section and located above the first contact. The conductive member is swung during up and down movement of the press element to connect with the first or the second contact. The connecting section has an isolation portion jutting sideward between the first and second contacts to prevent generation of a conductive layer caused by connection of the conductive member with the first and second contacts on the connecting section. Thus secured insulation can be formed between the first and second contacts to withstand a higher voltage test.

7 Claims, 5 Drawing Sheets

ENHANCED WITHSTAND VOLTAGE MICRO SWITCH

FIELD OF THE INVENTION

The present invention relates to an enhanced withstand voltage micro switch and particularly to a micro switch to isolate carbon deposition generated during switching operation to enhance withstand voltage.

BACKGROUND OF THE INVENTION

Advance of technology has made all kinds of electronic devices (such as mouse) smaller. Electronic elements required by those electronic devices also have to be miniaturized. In the electronic devices, switch is the commonly used electronic element to transmit signals.

References for micro switch are seen in numerous prior arts, such as R.O.C. patent Nos. M350087, 507921 and 289485. R.O.C. patent No. M350087 discloses a micro switch including a housing, a common terminal, a normally-closed terminal, a normally-open terminal, a movable contact plate, a tension spring, a pushbutton and a pressing plate. The pressing plate has a dovetail portion to increase the force receiving area of the housing from the pressing plate to avoid the housing from being pierced through. In addition, the tension spring improves control of received force of the movable contact plate to obtain uniform and agile action force, thereby to further enhance performance and reliability of the movable contact plate.

R.O.C. patent No. 507921 also discloses a micro switch including an upper body and a lower body coupled together, a conduction contact and a fixed contact surface on the top of the lower body, an action member with a fixed end anchored on the fixed contact surface and a movable end fastened to a contact element. When a press element is pressed, the bottom thereof is to push the action member. The movable end of the action member is moved accordingly to allow the contact element to contact with the conduction contact to achieve switch function.

R.O.C. patent No. 289485 discloses a micro switch with a detent rib that has a cap with two protrusive rectangular ribs on the surface to control depression movement of the switch to improve durability.

While all the aforesaid prior arts have varying objectives and functions, they have a common feature. Referring to FIG. 1, a micro switch is provided and similar to the micro switches disclosed in the aforesaid prior arts. The micro switch includes a base 30 which has a common terminal 31, a normally-closed terminal 33 and a normally-open terminal 32 located thereon. The common terminal 31 is coupled with a conductive reed 34 which contacts with the normally-closed terminal 33 in normal conditions. When being depressed, the conductive reed 34 contacts with the normally-open terminal 32 to achieve switch function.

However, when the micro switch is installed on an electronic device, the conductive reed 34 is moved up and down to contact with the normally-closed terminal 33 and normally-open terminal 32, and generates discharge and arc to fuse the contact, thus carbon residues are produced and sprayed around. Since the sprayed carbon residues contain metal powders, they are accumulated after a period of time to form a conductive layer 35 connected to the normally-closed terminal 33 and normally-open terminal 32. The normally-closed terminal 33 and normally-open terminal 32 are set ON to cause failure of the micro switch during safety high voltage test, and also cannot pass safety approval of higher ampere. Production yield also is decreased.

SUMMARY OF THE INVENTION

The primary object of the present invention is to solve the aforesaid disadvantages to achieve secured insulation of the terminals in the micro switch to prevent undesirable conduction or electrical connection among the terminals.

To achieve the foregoing object, the invention provides an enhanced withstand voltage micro switch which includes a base, and a first pin, a second pin and a third pin running through the base. The base is coupled with a cap having a press element movable up and down. The base and the cap form a housing compartment between them to hold a connecting section extended upwards. The connecting section has an isolation portion jutting sideward. The first pin has a first contact on the same side of the isolation portion. The second pin has a second contact extended from the connecting section and located above the first contact. The isolation portion is located at a height between the first contact and the second contact. The third contact has an anchor portion in the housing compartment to couple with a conductive member depressed by the press element. The conductive member is swung to connect with the first contact or the second contact during up and down movements of the press element. The isolation portion can isolate a conductive layer formed by carbon deposition generated by discharge caused by connection of the conductive member with the first contact or the second contact on the connecting section. Therefore, insulation between the first contact and the second contact can be ensured.

In an embodiment of the invention, the isolation portion is a boss extended from the connecting section and spaced from the first contact by a gap to prevent generation of the conductive layer formed by carbon deposition from contacting the first contact. The isolation portion can also be formed in an inclined direction towards the first contact or the second contact, or perpendicular to the connecting section to intercept or isolate the carbon deposition.

Compared with the conventional techniques, the present invention can maintain secured insulation between the first contact and the second contact of the micro switch to improve accuracy of circuit switch or signal output.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
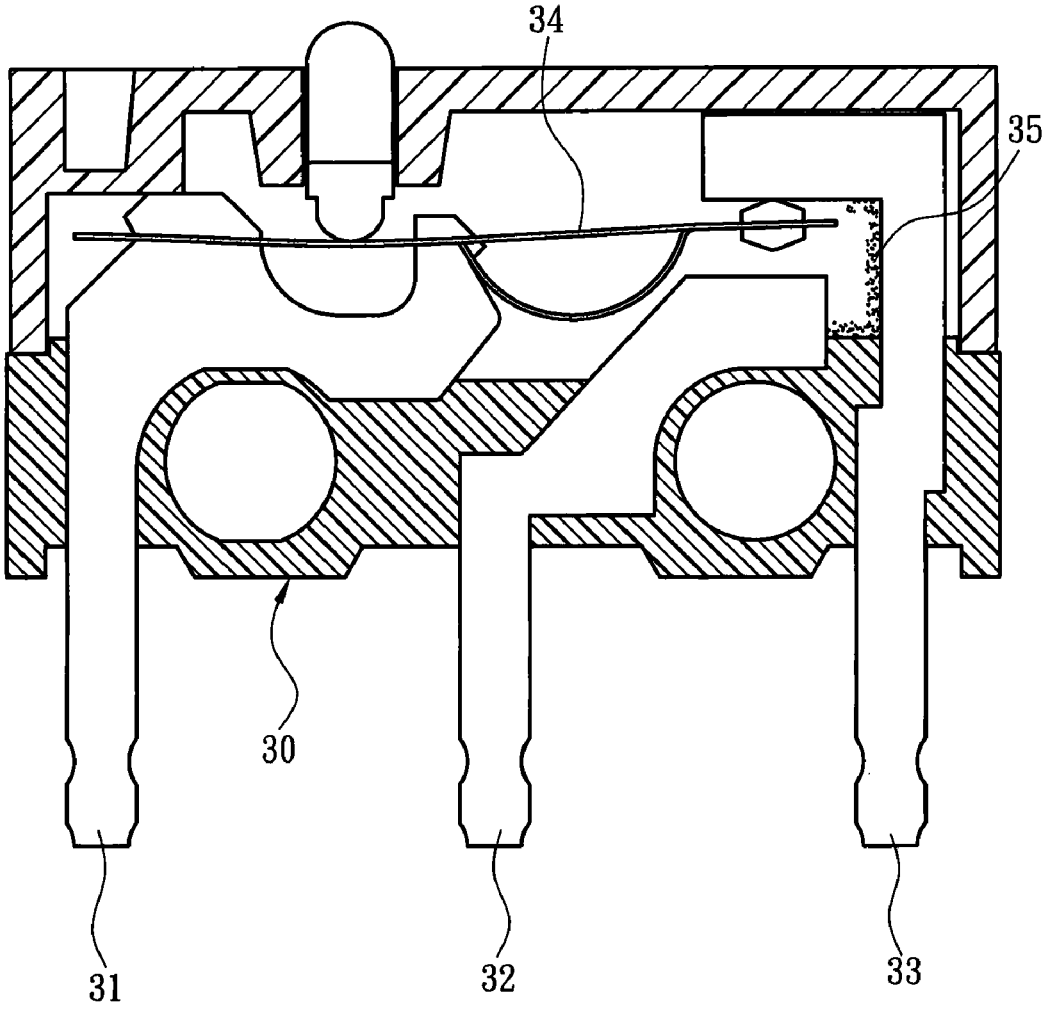
Fig. 1 PRIOR ART
FIG. 1 is a schematic view of a conventional technique.
Figure 2:
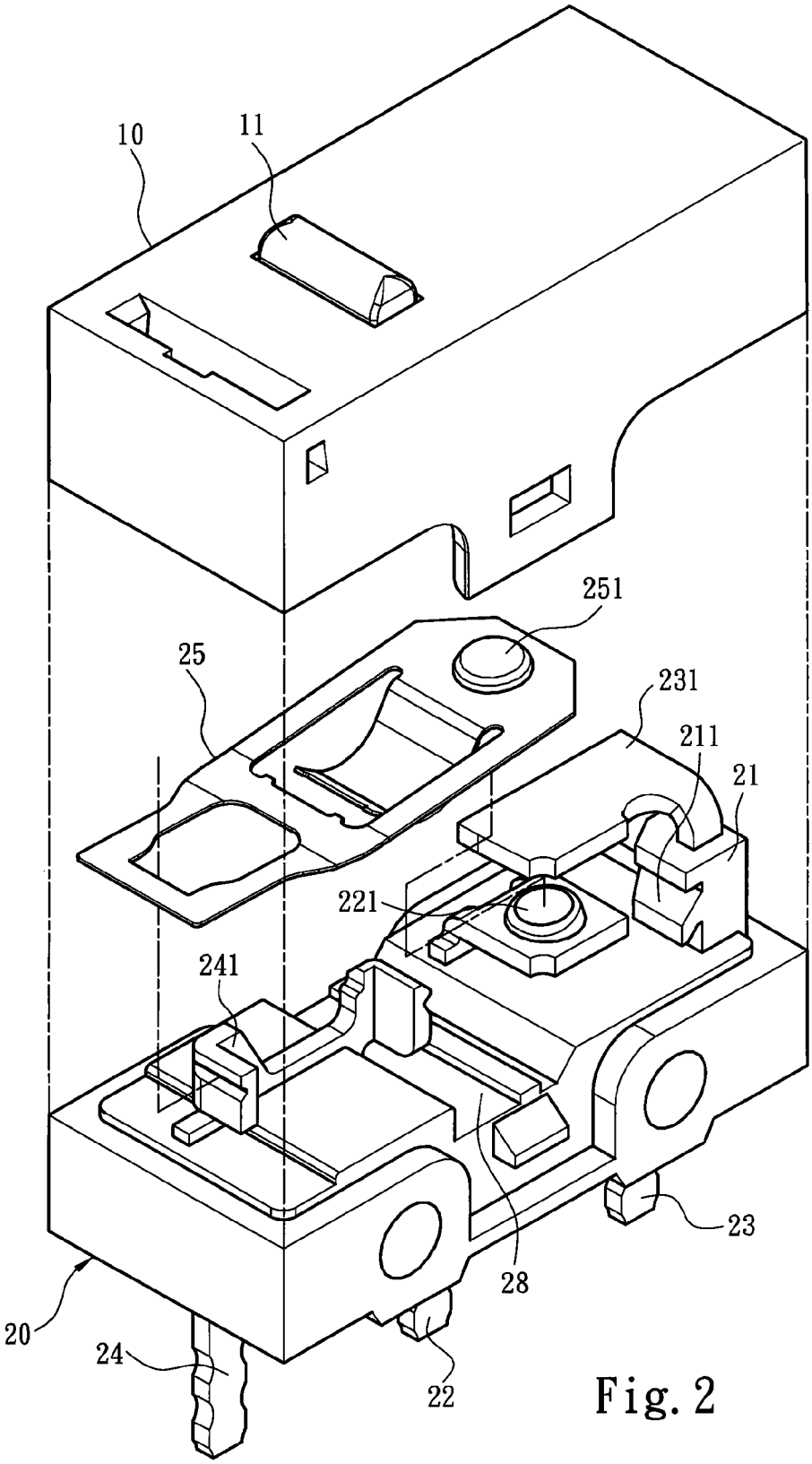
FIG. 2 is an exploded view of the invention.
Figure 3:
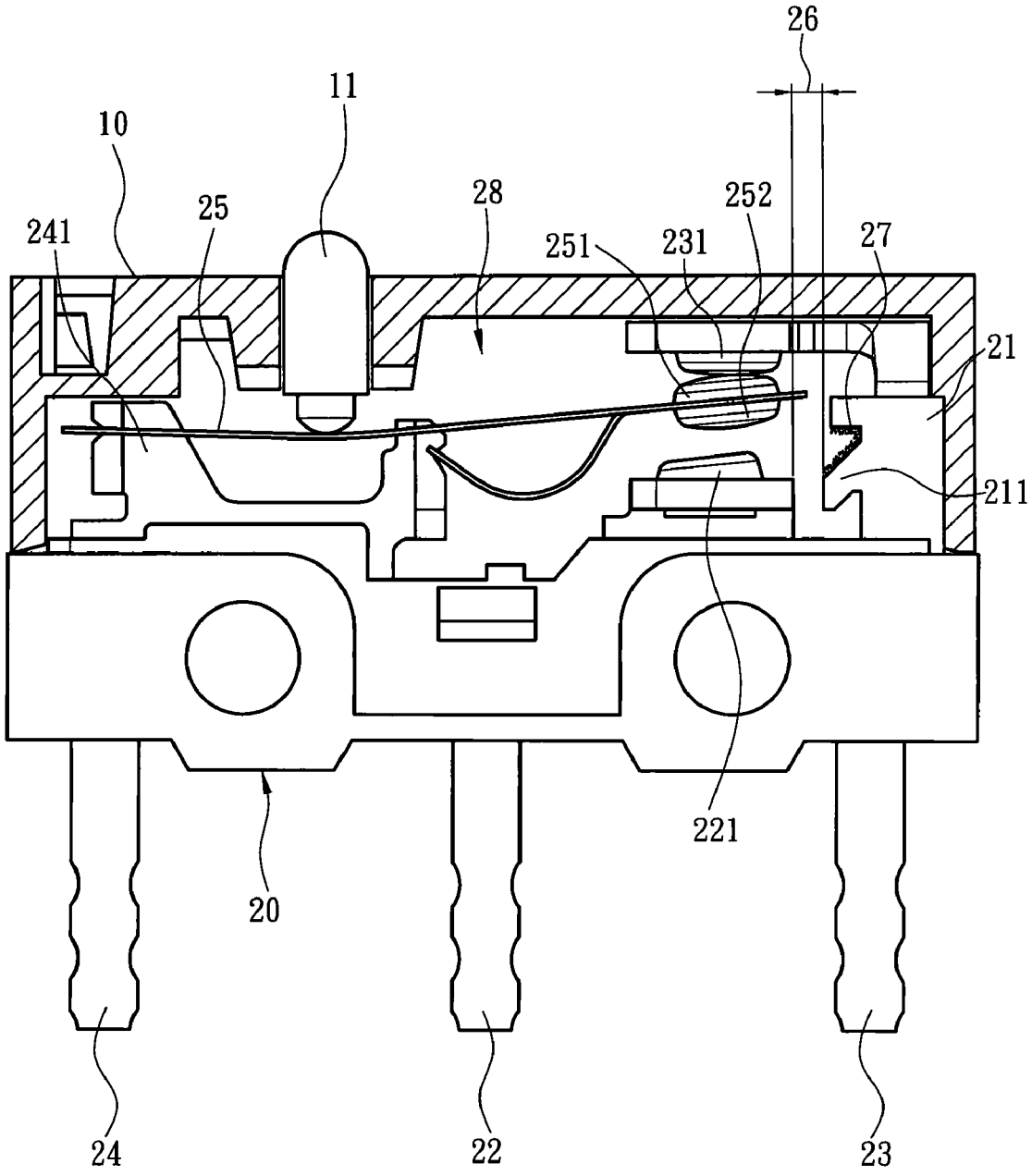
FIG. 3 is a sectional view of the invention.

Please refer to FIGS. 2 and 3, the present invention aims to provide an enhanced withstand voltage micro switch which mainly includes a base 20 and a cap 10 covering the base 10 to form a housing compartment 28 between them. The base 20 also has a connecting section 21 extended upwards in the housing compartment 28. The connecting section 21 has an isolation portion 211, such as a boss, jutting sideward. The base 20 is run through by a first pin 22, a second pin 23 and a third pin 24. The micro switch is coupled to an electronic device, such a circuit board (not shown in the drawings), through the first, second and third pins 22, 23 and 24. The first pin 22 has a first contact 221 at the same side of the isolation portion 211 on the base 20. The second pin 23 has a second contact 231 extended from the connecting section 21 and located above the first contact 221. The isolation portion 211 is located at a height between the first contact 221 and second contact 231. The third pin 24 has an anchor portion 241 formed on the base 20 to couple with a conductive member 25. The conductive member 25 is a conductive reed with one end fastened to the anchor portion 241 and another end formed a lower contact element 252 corresponding to the first contact 221 and an upper contact element 251 corresponding to the second contact 231.

The cap 10 has a press element 11 movable up and down to push the conductive member 25 so that the lower contact element 252 can connect the first contact 221, or the upper contact element 251 can connect the second contact 231, thereby to form conduction between the third pin 24 and the first pin 22 or the second pin 23 to form a corresponding circuit. Through the isolation portion 211 jutting from the connecting section 21 between the first and second contacts 221 and 231, a conductive layer 27 formed by carbon deposition generated by discharge caused by connection of the conductive member 25 with the first and second contacts 221 and 231 on the connecting section 21 can be isolated, thus secured insulation can be formed between the first and second contacts 221 and 231. Moreover, the isolation portion 211 and the first contact 221 are spaced from each other by a gap 26 to prevent the isolation portion 211 from connecting the first contact 221 to form short circuit. Thus forms the main structure of the invention.

Figure 4:
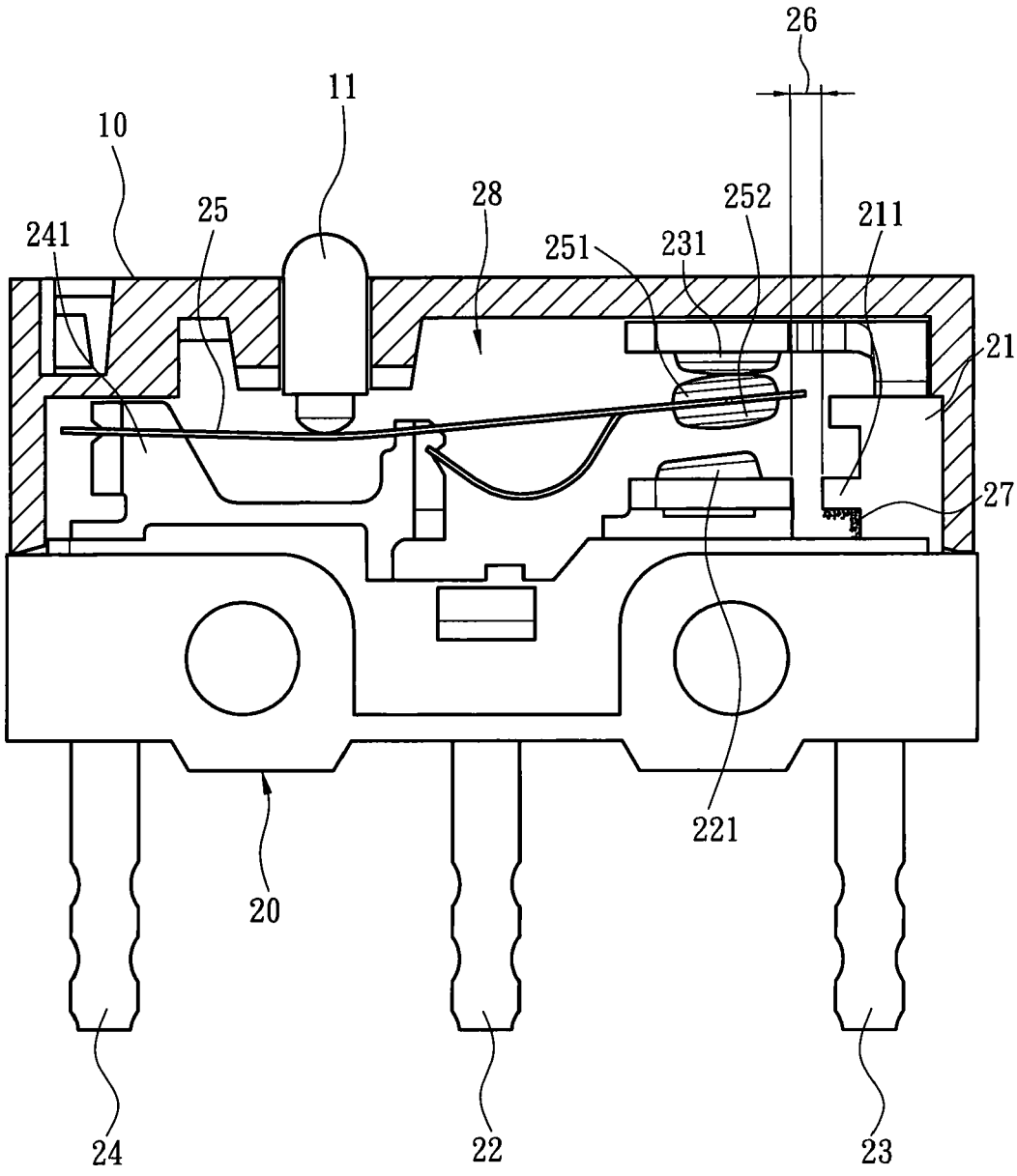
FIG. 4 is a sectional view of another embodiment of the invention.
Figure 5:
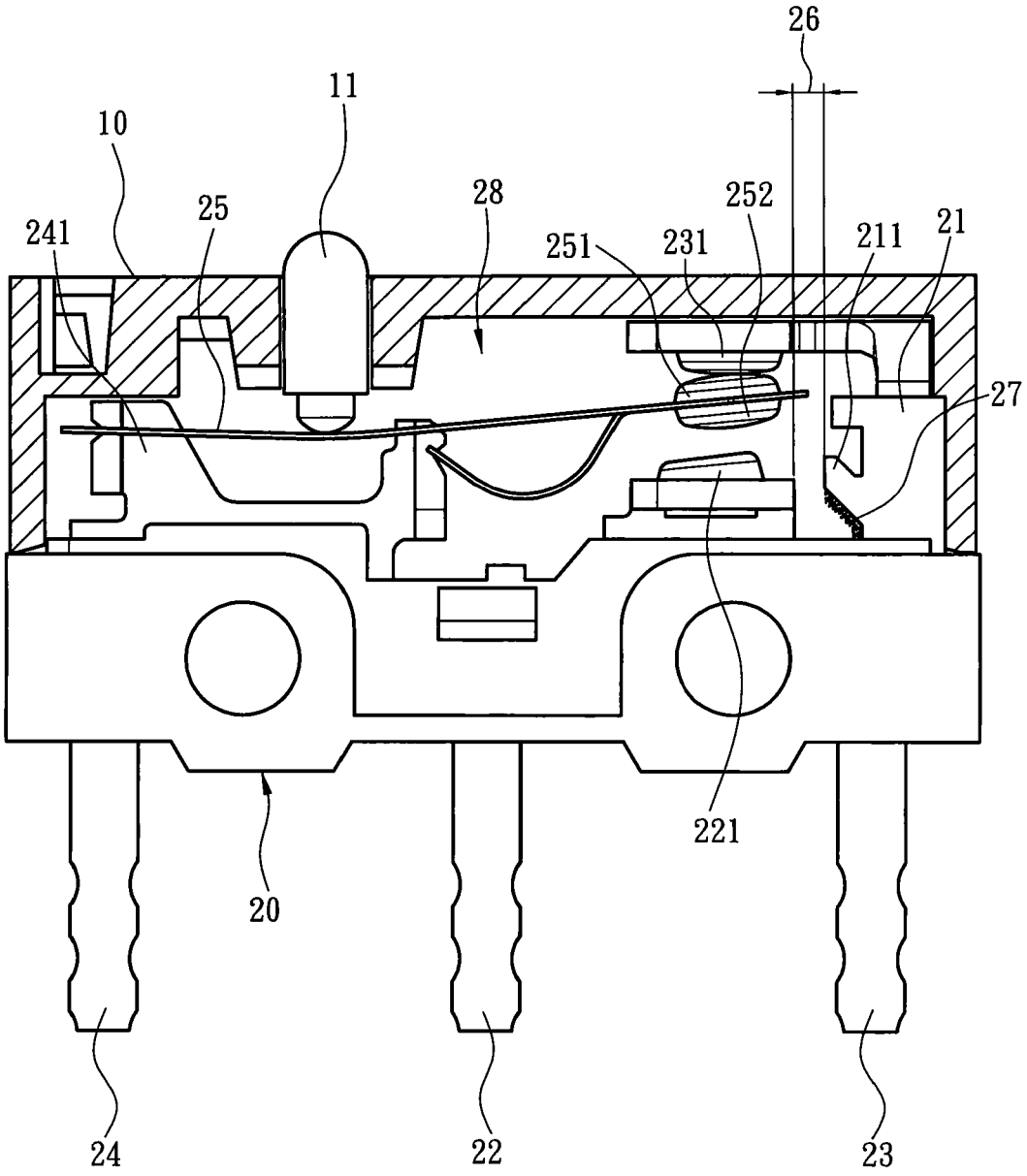
FIG. 5 is a sectional view of yet another embodiment of the invention.

In embodiments of the invention, there is no limitation to the angle between the isolation portion 211 and connecting section 21. The isolation portion 211 can be inclined upwards or downwards, or positioned horizontally. Referring to FIG. 3, the isolation portion 211 is inclined towards the first contact 221 to prevent the carbon deposition from adhering to the lower side of the connecting section 21 close to the first contact 221. FIG. 4 shows another embodiment with the isolation portion 211 perpendicular to the connecting section 21 to separate the carbon deposition in the upper side and lower side. FIG. 5 illustrates yet another embodiment with the isolation portion 211 inclined towards the second contact 231 to prevent the carbon deposition from adhering to the upper side of the connecting section 21 close to the second contact 231.

As a conclusion, the micro switch according to the invention mainly provides an isolation portion 211 on the connecting section 21 between the first contact 221 and second contact 231. The isolation portion 211 is located at one side where the conductive member 25 connects the first contact 221 and second contact 231 so that when the conductive member 25 connects the first or second contact 221 or 231 to form discharge, carbon deposition generated is intercepted and isolated by the isolation portion 211 and is less likely to form a conductive layer 27. As a result, secured insulation can be formed between the first contact 221 and second contact 231. The micro switch thus formed not only can withstand a higher voltage test, also can pass safety approval of greater ampere. Production yield and stability of the products improve, and accuracy of circuit switch or signal output also is enhanced.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An enhanced withstand voltage micro switch, comprising:

a base coupled with a cap which includes a press element movable up and down, the base and the cap forming a housing compartment between them to hold a connecting section extended upwards from the base, the connecting section including an isolation portion jutting sideward;

a first pin running through the base and including a first contact at the same side of the isolation portion;

a second pin running through the base and including a second contact extended from the connecting section and located above the first contact, the isolation portion being located at a height between the first contact and the second contact; and a third pin running through the base and including an anchor portion in the housing compartment to couple with a conductive member depressed by the press element, the conductive member being swung during up and down movement of the press element to connect with the first contact or the second contact, the isolation portion isolating generation of a conductive layer caused by connection of the conductive member with the first contact or the second contact on the connecting section.

2. The enhanced withstand voltage micro switch of claim 1, wherein the isolation portion is a boss extended from the connecting section.

3. The enhanced withstand voltage micro switch of claim 1, wherein the isolation portion and the first contact are spaced from each other by a gap.

4. The enhanced withstand voltage micro switch of claim 1, wherein the isolation portion is inclined towards the first contact.

5. The enhanced withstand voltage micro switch of claim 1, wherein the isolation portion is inclined towards the second contact.

6. The enhanced withstand voltage micro switch of claim 1, wherein the isolation portion is perpendicular to the connecting section.

7. The enhanced withstand voltage micro switch of claim 1, wherein the conductive member includes a lower contact element to connect with the first contact and an upper contact element to connect with the second contact.

* * * * *